US006984296B1

(12) United States Patent
Gestermann

(10) Patent No.: US 6,984,296 B1
(45) Date of Patent: Jan. 10, 2006

(54) ELECTROCHEMICAL CELL FOR ELECTROLYZERS WITH STAND-ALONE ELEMENT TECHNOLOGY

(75) Inventor: Fritz Gestermann, Leverkusen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 294 days.

(21) Appl. No.: 10/148,138

(22) PCT Filed: Nov. 20, 2000

(86) PCT No.: PCT/EP00/11531

§ 371 (c)(1),
(2), (4) Date: May 28, 2002

(87) PCT Pub. No.: WO01/40549

PCT Pub. Date: Jun. 7, 2001

(30) Foreign Application Priority Data

Dec. 1, 1999 (DE) ..... 199 59 079

(51) Int. Cl.
*C25C 1/46* (2006.01)

(52) U.S. Cl. ..... 204/252; 204/253

(58) Field of Classification Search ..... 204/252
See application file for complete search history.

(56) References Cited

U.S. PATENT DOCUMENTS

| | | | | |
|---|---|---|---|---|
| 3,655,167 | A * | 4/1972 | Skille | 256/35 |
| 5,693,202 | A | 12/1997 | Gestermann et al. | 204/265 |
| 6,165,332 | A | 12/2000 | Gestermann et al. | 204/258 |
| 6,283,162 | B1 * | 9/2001 | Butler | 138/177 |

FOREIGN PATENT DOCUMENTS

| | | |
|---|---|---|
| DE | 196 41 125 | 4/1998 |
| DE | 19715429 | 10/1998 |
| DE | 19859882 | 12/1999 |

* cited by examiner

*Primary Examiner*—Roy King
*Assistant Examiner*—Harry D. Wilkins, III
(74) *Attorney, Agent, or Firm*—Joseph C. Gil

(57) ABSTRACT

The invention describes an electrochemical cell for the membrane electrolysis process for electrolyzers with single-element technology. The cell consists of at least of 2 half-shells (8, 10), which surround an anolyte chamber (16) and a cathode chamber (22) with a membrane (5) arranged in between, and an anode (6) in the anolyte chamber (16), with the cathode chamber (22) being provided with an oxygen-consuming cathode (4), with a plurality of pressure-compensated gas pockets (15) arranged one above the other, a catholyte gap (14) and optionally a back chamber (19), where electrically conducting supporting elements (7) are provided in the anolyte chamber (16) and supporting elements (3, 2, 1) are provided in the cathode chamber (22) at the same position opposite one another.

13 Claims, 3 Drawing Sheets

ELECTROCHEMICAL CELL FOR ELECTROLYZERS WITH STAND-ALONE ELEMENT TECHNOLOGY

Figure 1:
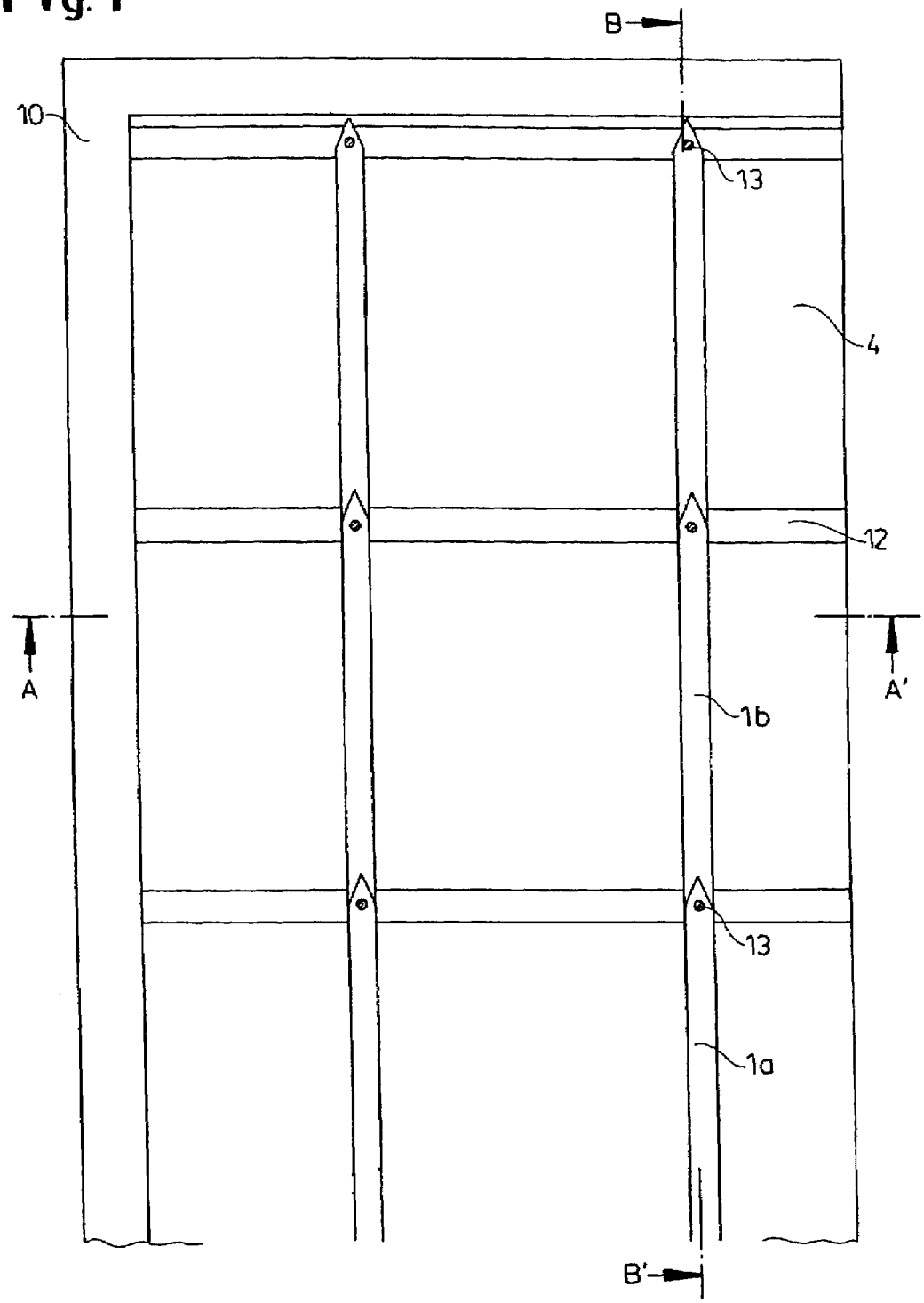

The invention relates to an electrochemical cell for electrolysers with single-element technology for the membrane electrolysis process in accordance with the preamble to claim 1. The cell consists of at least 2 half-shells which surround an anolyte chamber and a cathode chamber with a membrane arranged in between, and an anode in the anolyte chamber, with the cathode chamber being provided with an oxygen-consuming cathode, with a plurality of pressure-compensated gas pockets arranged one above the other, a catholyte gap and optionally a back chamber, with electrically conducting supporting elements being provided in the anolyte chamber and supporting elements being provided in the cathode chamber at the same positions opposite one another.

Electrolysers, for example for NaCl electrolysis, are known in two fundamentally known basic technologies for the bipolar method.

In the filter press technology, the cell elements are arranged within the frame in the manner of half-shells welded back to back, with the anode and cathode each being located on the outside in a free-standing manner, and the ion exchanger membrane inserted between two elements forming the electrochemical cell. The current from cell to cell flows via the weld seams between the half-shells.

In the single-element technology, the electrochemical cell is formed by two individual electrode half-shells, between which a membrane is placed and which are then bolted together to form a single element. The electrical contacting from single element to single element takes place by pressing together a pack of single elements, which are electrically connected to one another via suitable contact strips. The externally acting pressing forces have to be passed on within the element structures.

The use of oxygen-consuming cathodes in pressure compensation operation with so-called gas pockets, as described in U.S. Pat. No. 5,693,202 in basic principle and in DE-A 196 22 744 A1 for gas pockets through which gas flows actively, takes place with an electrolyte gap between the oxygen-consuming cathode and the membrane. At the same time, the gas pocket itself represents an empty volume. Both structures, which are undefined for force transmission, have to be bridged by means of a system which is suitable for the transmission of stress forces. At the same time, the aim is to utilize the stress force for a further improvement in the current distribution into the oxygen-consuming cathode via press contacts.

The gas pockets containing the oxygen-consuming cathodes usually extend over the entire width of the electrolysis cell. The structures for transmitting the stress forces are, for hydraulic reasons, arranged vertically, as in the case of hydrogen-producing electrolysis. For the crossing functions here, a pragmatically simple solution had to be found which can be integrated both into new electrolysis elements from the outset and also enables retrofitting of electrolyses currently working in hydrogen operation.

The object is achieved in accordance with the invention by an electrochemical cell for the membrane electrolysis process, consisting at least of 2 half-shells, which surround an anolyte chamber and a cathode chamber with a membrane arranged in between, and an anode in the anolyte chamber, with the cathode chamber being provided with an oxygen-consuming cathode, with a plurality of pressure-compensated gas pockets arranged one above the other, a catholyte gap and optionally a back chamber, which is characterized in that electrically conducting supporting elements are provided in the anolyte chamber and further supporting elements are provided in the cathode chamber at the same positions opposite one another, which absorb the pressing forces acting on the half-shell walls.

A preferred embodiment of the electrochemical cell is characterized in that the support in the cathode chamber takes place by means of a multi-part supporting element, where one supporting part is arranged in the catholyte gap, a further supporting part is arranged in the gas pocket and, if a back chamber is present, a third supporting part is arranged in the back chamber behind the gas pockets.

The back of the gas pockets is, in particular, welded to the vertical supporting elements for force and current transmission. Structural beams, for example, or vertically running structural bridges of other types are preferably welded into the gas pockets via these weld seams as supporting elements, which are so high that they have the same level as the peripheral outer edge of the gas pocket.

Irrespective of the embodiment selected, these internal fittings must facilitate horizontal passage of gas through the gas pocket and also horizontal outflow of any condensate at the lower edge.

After the oxygen-consuming cathodes have been installed, these are located, for example, flat on the structural beams or bridges and on the edge of the gas pockets and form a planar surface over the full width and the respective height of the gas pocket.

In order to bridge the catholyte gap between the oxygen-consuming cathode and the membrane, a supporting element is, in particular, installed as supporting element made from electrolyte- and heat-resistant material as counterpart to the above-mentioned structural beams or bridges and is itself supported via the oxygen-consuming cathode and on the other hand via the membrane at the anode structure, which is likewise supported in this region, and thus facilitates force transmission through the electrochemical cell.

The supporting element (spacer) is preferably not installed in one piece in the cell, for the following reasons. Firstly, reliable positioning relative to the above-mentioned structural beams or bridges is not ensured over the full height, even small lateral deformations potentially resulting in slipping, with the risk of destruction of the oxygen-consuming cathode, and secondly the coefficients of thermal expansion differ so much that lateral bending out is probable, favored by the sliding effect through the catholyte. For this reason, it is advantageous to split the supporting element into pieces and to divide it into segments which correspond to the height of the respective individual gas pockets. The segments of the supporting elements are, in particular, attached or guided at the top and bottom in accordance with the following scheme: at the upper end, they are attached to the edge of the gas pocket. This can take place either via a pin or a type of snap fastener either at the spacer or, however, at the upper edge of the gas pocket, it being necessary for the respective opposite part to contain a corresponding hole.

A preferred variant of the invention is consequently characterized in that the supporting part in the catholyte gap is formed from a plurality of bars arranged one above the other, which are optionally attached at their upper end via a detachable connecting means, for example a snap-fit connector, to cross-braces which carry the electrode.

At the lower end, the supporting element terminates in a dovetail-shaped structure which surrounds the pointed upper end of the next supporting element beneath and thus ensures the horizontal positioning of the supporting element. The gap between these two segments is advantageously selected in such a way that the greater thermal expansion of the supporting element compared with the metallic structures is compensated.

In a preferred variant of the electrochemical cell, the respective adjoining ends of the supporting parts are therefore designed as a tongue-and-groove combination, with the upper end of the respective lower supporting part being designed, in particular, as the tongue.

Good force distribution occurs in the cell if the supporting elements extend over the entire height of the half-shells.

The second supporting part in the gas pockets has openings or leaves passages open, particularly preferably at selected points, in particular in its upper and lower region of the respective gas pocket.

The second supporting part is particularly preferably designed in the form of solid electrically conductive bars or as a U-profile, or, however, as corresponding vertical embossing of the back of the gas pocket.

In order to ensure even more reliable positioning of the supporting element, the structural beams or bridges can be provided with slight vertical arching either to the right or left or, however, in the center, which corresponds to a corresponding shaping of the supporting elements, so that the latter is always re-centered on the opposite structure on distortion of the electrolyser.

The oxygen-consuming cathode should be, in particular, electrically conductive on its back. Besides the metallic connection of the oxygen-consuming cathode to the edge of the gas pocket, this provides a further electrical connection through press contact via the electrically conductive supporting elements, which results in a further minimization of the resistance losses. In addition, the use of the supporting element prevents the oxygen-consuming cathode from bulging into the catholyte gap over a large area, with the risk of local blockage of the catholyte flow through contact with the membrane. This applies, in particular, in the case of the above-mentioned structuring of the supporting elements by means of which the oxygen-consuming cathode is stressed.

The supporting elements in the catholyte gap are, in particular in the case of chloralkali electrolysis, advantageously made of ECTFE, FEP, MFA or PFA, while the electrically conducting supporting elements, for example structural beams or bridges, should consist of nickel or another caustic lye-resistant metal alloy or are embossed directly out of the back wall of the gas pocket.

In the case of an oxygen-consuming cathode which is metallic or electrically conducting on its front, the supporting elements in the catholyte gap may be metallic on the side facing the oxygen-consuming cathode in order to obtain an improvement in the current distribution into the oxygen-consuming cathode via the press contact. In this case, the supporting elements preferably have a two-layered structure, with the side facing the membrane consisting of ECTFE, FEP, MFA or PFA, while the metallic part consists of caustic lye-resistant metal.

Figure 2:
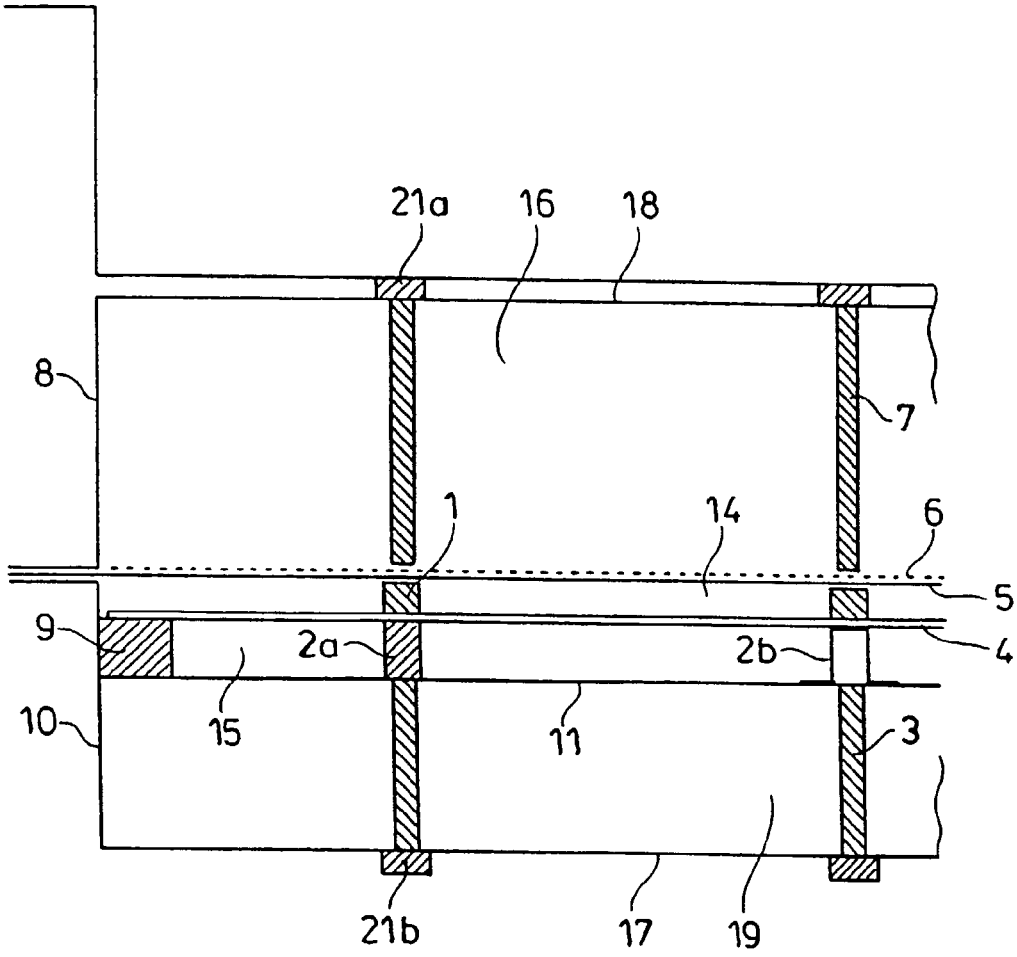
Figure 3:
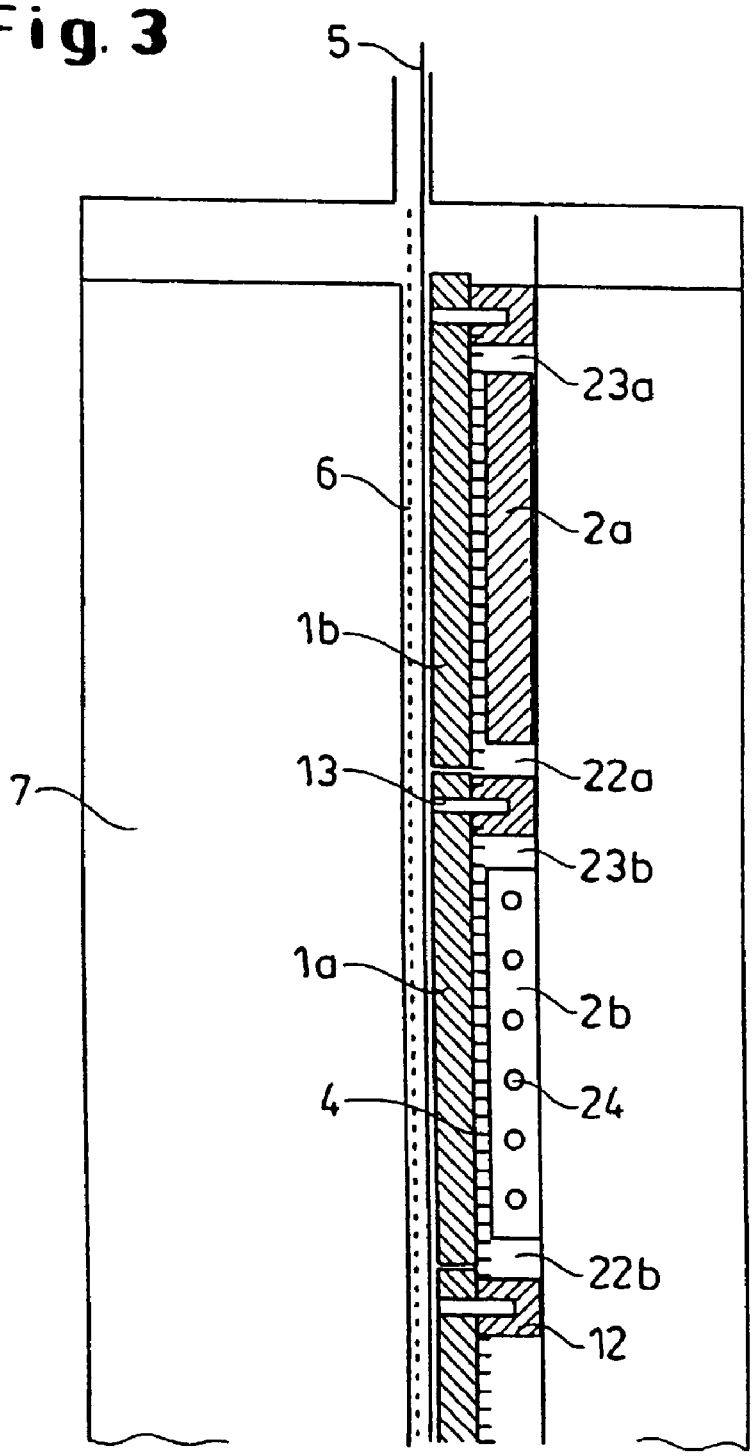

The use of the force transmission described in the single-element technology is not restricted just to chloralkali electrolysis, but can also be used for all electrolyses with gas-diffusion electrodes in direct contact with liquid electrolytes which require pressure compensation, such as, for example,

- hydrogen peroxide production with an oxygen-consuming cathode,
- sodium dichromate electrolysis with a hydrogen-consuming anode and an oxygen-consuming electrode
- alkaline fuel cells for enrichment of sodium hydroxide solution
- hydrochloric acid electrolysis with an oxygen-consuming cathode The invention is explained in greater detail by way of example below with reference to the figures, in which:

FIG. 1 shows a longitudinal section through a cathode half-shell of a cell according to the invention as a detail of the top left corner FIG. 2 shows a cross section corresponding to line A–A' in FIG. 1 through the electrochemical cell FIG. 3 shows a longitudinal section through a cathode half-shell corresponding to line B–B' in FIG. 1

EXAMPLES

FIG. 1 shows the view of the cathode half-shell with the top left corner as detail, and FIG. 2 shows a horizontal section A–A' through a gas pocket 15. In the cathode half-shell 10, the gas pocket structure with back wall 11 and lateral frame 9 is supported via the supporting structure 3.

The vertical structural beams 2*a* or [lacuna], according to a variant shown in the same FIG. 2 or 3, the vertical structural bridge 2*b* is welded into the gas pocket 15. In order to ensure cross-transport of oxygen in the gas pocket 15, the two structures are open and are not on the horizontal limit 12 of the gas pocket 15 in order to facilitate outflow of any condensate formed from the oxygen-consuming cathode. The oxygen-consuming cathode 4 is attached in an electrically conductive and gas-tight manner on and to the lateral frame 9 and the horizontal limit 12 and is situated on the structural beams or bridges. The catholyte gap 14 between the membrane 5 and the oxygen-consuming cathode 4 is defined by the spacer elements 1, which are in turn supported via the membrane at the anode 6, which is held in a defined manner in the anode half-shell 8 via the supporting structure 7 (cf. FIG. 2).

The anode half-shell 8 and cathode half-shell 10 are connected to one another in a liquid-tight manner and form a single element (electrolysis cell). When the electrolyser is pressed together, a large number of such single elements are pressed together, with the respective next anode half-shell 8' of adjacent single elements being pressed onto the cathode half-shell 10 and the next cathode half-shell 10' of an adjacent single element on the other side of the single element being pressed onto the anode half-shell 8. The pressing together of the single element places a load, via the cathode half-shell 10, on the supporting structure 3, the vertical structural beam 2*a* or the vertical structural bridge 2*b* and the spacer 1, which presses on the one hand against the oxygen-consuming cathode 4 and on the other hand via the membrane 5 against the anode 6. This transmits stress forces via the supporting structure 7 to the anode half-shell 8. The electrical contacting of single element to single element takes place by pressing against the contact strips 21*a* and 21*b*.

The spacer elements 1*a*, 1*b* themselves are designed with a taper to a point at the top and are provided at the bottom with a corresponding dovetail structure (FIG. 1). They are attached to the top to the horizontal limit 12 of the gas pocket 15 by means of a pin or a snap fastener-like holding device 13. The dovetail of the spacer element 1*b* engages over the tip of the next spacer element 1*a* beneath and is thus positioned unequivocally. At the same time, a defined gap between the spacer elements 1*a*, 1*b* facilitates their free thermal expansion, which, due to the material, is greater than that of the metallic structures.

What is claimed is:

1. An electrochemical cell for the membrane electrolysis process, consisting of at least of 2 half-shells (8, 10), which surround an anolyte chamber (16) and a cathode chamber (22) with a membrane (5) arranged in between, and an anode (6) in the anolyte chamber (16), with the cathode chamber (22) being provided with an oxygen-consuming cathode (4), with a plurality of pressure-compensated gas pockets (15) arranged one above the other, a catholyte gap (14) and optionally a back chamber (19), characterized in that electrically conducting supporting elements (7) are provided in the anolyte chamber (16) and supporting elements (3, 2, 1) are provided in the cathode chamber (22) at the same positions opposite one another and support one another, wherein the support in the cathode chamber (22) takes place by means of a multi-part supporting element (3, 2, 1), where one supporting part (1) is arranged in the catholyte gap (14), a further supporting part (2*a*; 2*b*) is arranged in the gas pocket (15) and, if a back chamber (19) is present, a third supporting part (3) is arranged in the back chamber (19) behind the gas pockets (15), the second supporting part (2*a*) or (2*b*) in the gas pockets (15) have openings (22*a*, 22*b*, 23*a*) or leave passages (24) open at selected points, in particular in their upper and lower region of the respective gas pocket (15), wherein the supporting part (1) in the catholyte gap (14) is formed from a plurality of bars (1) arranged one above the other, which are attached at their upper end via a detachable connecting means (13) to cross-braces (12) which carry the electrode (4), and wherein the supporting elements (3, 2, 1) extend over the entire height of the half-shell (10) and are located opposite a continuous supporting element (7) in the second half-shell 8.

2. An electrochemical cell as claimed in claim 1, characterized in that the respectively adjoining ends of the supporting parts (1*a*, 1*b*) are designed as a tongue-and-groove combination, with the upper end of the respective lower supporting part (1*a*) being designed, in particular, as the tongue.

3. An electrochemical cell as claimed in claim 2, characterized in that the second supporting part (2) is designed either as a solid electrically conductive bar (2*a*) or as a U-profile (2*b*).

4. An electrochemical cell as claimed in claim 2, characterized in that the supporting elements (7, 3 and 2) are made of caustic lye-resistant metals or alloys, in particular from nickel, or from acid-resistant metals or alloys, in particular from titanium or alloys of titanium and palladium.

5. An electrochemical cell as claimed in claim 2, characterized in that the supporting elements (1, 1*a* or 1*b*) consist of a heat- and electrolyte-resistant plastic.

6. An electrochemical cell as claimed in claim 2, characterized in that the supporting elements (1, 1*a*, 1*b*) are made metallically conducting on the side facing the oxygen-consuming cathode (4).

7. An electrochemical cell as claimed in claim 1, characterized in that the second supporting part (2) is designed either as a solid electrically conductive bar (2*a*) or as a U-profile (2*b*).

8. An electrochemical cell as claimed in claim 7, characterized in that the U-profile (2*b*) has been embossed out of the back wall of the gas pocket, and the supporting element (3) extends into the base of the embossed U-profile (2*b*) and thus directly causes the transmission of force.

9. An electrochemical cell as claimed in claim 1, characterized in that the supporting elements (7, 3 and 2) are made of caustic lye-resistant metals or alloys, in particular from nickel, or from acid-resistant metals or alloys, in particular from titanium or alloys of titanium and palladium.

10. An electrochemical cell as claimed in claim 1, characterized in that the supporting elements (1, 1*a* or 1*b*) consist of a heat- and electrolyte-resistant plastic.

11. An electrochemical cell as claimed in claim 1, characterized in that the supporting elements (1, 1*a*, 1*b*) are made metallically conducting on the side facing the oxygen-consuming cathode (4).

12. An electrochemical cell as claimed in claim 1, characterized in that the supporting elements (3, 2, 1) extend over the entire height of the half-shell (10) and are located opposite a continuous supporting element (7) in the second half-shell 8.

13. The electrochemical cell as claimed in claim 1, wherein the detachable connecting means (13) is a snap-fit connector (13), to cross-braces (12) which carry the electrode (4).

* * * * *